US012693095B1

(12) United States Patent
Chen et al.

(10) Patent No.: US 12,693,095 B1
(45) Date of Patent: Jul. 28, 2026

(54) AUXILIARY DEVICE FOR CALIBRATING AIM POINT OF FIREARM

(71) Applicant: Shenzhen Yinglu Technology Development Co., Ltd., Shenzhen (CN)

(72) Inventors: Guozheng Chen, Shenzhen (CN); Bilan Pan, Shenzhen (CN)

(73) Assignee: Shenzhen Yinglu Technology Development Co., Ltd., Shenzhen (CN)

( * ) Notice: Subject to any disclaimer, the term of this patent is extended or adjusted under 35 U.S.C. 154(b) by 0 days.

(21) Appl. No.: 19/250,015

(22) Filed: Jun. 25, 2025

Related U.S. Application Data

(63) Continuation of application No. 19/025,776, filed on Jan. 16, 2025, now abandoned.

(51) Int. Cl.
*F41G 1/54* (2006.01)

(52) U.S. Cl.
CPC ..... *F41G 1/545* (2013.01)

(58) Field of Classification Search
CPC ..... F41G 1/545; F41G 1/54
USPC ..... 42/134, 116
See application file for complete search history.

(56) References Cited

U.S. PATENT DOCUMENTS

| | | | | |
|---|---|---|---|---|
| 6,289,624 | B1 * | 9/2001 | Hughes | F41G 1/545 42/116 |
| 6,295,753 | B1 * | 10/2001 | Thummel | F41A 33/02 42/116 |
| 6,397,509 | B1 * | 6/2002 | Langner | F41G 1/54 42/114 |
| 6,421,947 | B1 * | 7/2002 | Fuller | F41G 1/545 42/116 |
| 8,132,354 | B1 * | 3/2012 | Sellers | F41G 1/54 42/116 |
| 8,695,266 | B2 * | 4/2014 | Moore | F41G 1/44 356/249 |
| 2007/0144051 | A1 * | 6/2007 | Moore | F41G 1/54 42/116 |
| 2012/0167440 | A1 * | 7/2012 | StPhillips | F41A 21/32 42/116 |

* cited by examiner

*Primary Examiner* — John Cooper
(74) *Attorney, Agent, or Firm* — Birchwood IP

(57) ABSTRACT

The application discloses an auxiliary device for calibrating an aim point of a firearm, comprising a shell internally provided with a laser emitting assembly which emits visible light beams. One end of the shell is provided with a light emitting hole, an outer side wall of the other end of the shell is provided with a first frustum inclined plane, a limiting mechanism is arranged at an end portion, and central axes of the light emitting hole, the first frustum inclined plane and the limiting mechanism are coincident. According to the application, the aim point calibration of the firearm is completed by observing the light beams, which greatly improves efficiency.

5 Claims, 4 Drawing Sheets

AUXILIARY DEVICE FOR CALIBRATING AIM POINT OF FIREARM

CROSS REFERENCE TO THE RELATED APPLICATIONS

The present application is a Continuation of U.S. patent application Ser. No. 19/025,776, filed on Jan. 16, 2025.

TECHNICAL FIELD

The present invention relates to the field of calibrating an aim point of a firearm, and more particularly, to an auxiliary device for calibrating an aim point of a firearm.

BACKGROUND

Most firearms are equipped with an aiming mechanism, which generally comprises a rear sight and a front sight. There is a gap in the rear sight. If an aiming structure of the firearm is calibrated correctly, a bullet fired by the firearm can hit a target if the gap, the front sight and the target are on the same line. A point on the same line with the gap and the front sight is the aim point.

After use, internal parts of the firearm often need to be maintained and cleaned, which requires disassembling and assembling the firearm. At present, most firearms are detachable. After the firearm is disassembled and reassembled, it is impossible to ensure that the aiming aim point throw is still correct, that is, it is impossible to ensure that the firearm hits the target through the gap and the front sight. Therefore, the aim point of the firearm generally needs to be recalibrated after disassembling and assembling to ensure accuracy of the aiming structure.

The traditional calibration method is usually a trial-and-error method, that is, shooting test, which judges an aiming deviation through a point of impact, and then makes corresponding adjustments to the front sight or the rear sight. In this way, it may take several attempts to complete the calibration, which not only wastes bullets, but also takes a long time and is inefficient.

SUMMARY

In order to solve the problems in the prior art, embodiments of the present application provide an auxiliary device for calibrating an aim point of a firearm, comprising a shell, wherein the shell is internally provided with a laser emitting assembly, the laser emitting assembly emits visible light beams, one end surface of the shell is provided with a light emitting hole, one end of the shell away from the light emitting hole is provided with a limiting end, and the limiting end is used for installing and limiting the auxiliary device on a barrel of the firearm; and an outer side wall of the limiting end is provided with a first circular truncated cone inclined surface, an end portion of the limiting end is provided with a limiting mechanism, and central axes of the light emitting hole, the first frustum inclined plane and the limiting mechanism are coincident.

As a further improvement of the present application, the limiting mechanism comprises a casing pipe and a first sealing piece, the first sealing piece is sleeved on an outer wall of the limiting end, the casing pipe is connected with one end of the limiting end away from the light emitting hole, the casing pipe is provided with a second sealing piece, and the first sealing piece and the second sealing piece are respectively coincident with the central axis of the first frustum inclined plane.

As a further improvement of the present application, the outer side wall of the limiting end is provided with a second frustum inclined plane, an inclined plane hole adapted to the second frustum inclined plane is arranged in the casing pipe, and the second frustum inclined plane is inserted into the inclined plane hole.

As a further improvement of the present application, the laser emitting assembly comprises a laser and a circuit board, and the laser is connected with the circuit board; and an accommodating cavity is arranged in the shell, a power supply assembly is arranged in the accommodating cavity, the power supply assembly is used for supplying power to the laser, and the power supply assembly is connected with the circuit board.

As a further improvement of the present application, the power supply assembly comprises a battery holder, a connecting piece is arranged on the battery holder, the battery holder is used for containing a battery, and the connecting piece is used for connecting the battery with the shell; an outer side of the shell is sleeved with a battery cover, the battery cover is connected with the battery holder, and the battery cover drives the battery holder to rotate and move; and when the battery cover drives the battery holder to rotate, the connecting piece is connected with the shell.

As a further improvement of the present application, an outer wall of the shell is provided with a first boss, and an inner wall of the battery cover is provided with a second boss; and when the battery cover drives the battery holder to move, an end surface of the second boss is abutted against an end surface of the first boss.

As a further improvement of the present application, the battery holder is provided with a clamping block, and the shell is provided with a limiting block; and when the battery cover drives the battery holder to move, the clamping block is abutted against the limiting block.

As a further improvement of the present application, a bump is arranged on a part of the shell connected with the battery holder, and a clamping groove adapted to the bump is arranged on the battery holder; and when the battery cover drives the battery holder to move, the bump is connected with the clamping groove.

As a further improvement of the present application, an elastic piece is arranged in the accommodating cavity, one end of the elastic piece is connected with a lower surface of an inner wall of the accommodating cavity, and the other end of the elastic piece is abutted with the battery holder.

As a further improvement of the present application, a jacking post is arranged in the accommodating cavity, one end of the jacking post is connected with the shell, the other end of the jacking post extends into the accommodating cavity, a lower end surface of the battery holder is provided with a through hole, and a diameter of the through hole is matched with an outer diameter of the jacking post; and when the battery cover drives the battery holder to move, the top post is inserted into the through hole.

When the auxiliary device is used for calibrating the aim point of the firearm, a user inserts the limiting end of the shell into the barrel of the firearm, and connects the auxiliary device with the firearm in a limiting way through the first frustum inclined plane and the limiting mechanism, and then the visible light beam is emitted through the laser emitting assembly. The central axes of the light emitting hole, the frustum inclined plane and the limiting mechanism are coincident, and the barrel can be ensured to be coincident with the central axis of the first frustum inclined plane through the cooperation of the first frustum inclined plane, thus ensuring that the light emitting hole and the central axis of the barrel are coincident. Therefore, it is possible to determine that a light emitting point of the laser emitting assembly is a hit point of the firearm, and then the firearm aiming calibration can be completed by adjusting the rear sight and the front sight to make the gap on the rear sight, the front sight and the light emitting point are in one straight line.

Compared with the prior art, the present application does not need shooting test, which can reduce an aiming calibration cost. By observing the visible light beams, the aim point calibration of the firearm can be quickly completed, which greatly reduces a time for the aim point calibration of the firearm and improves efficiency.

BRIEF DESCRIPTION OF DRAWINGS

In order to illustrate the technical solutions of the present application or the prior art more clearly, the drawings used in the description of the embodiments or the prior art will be briefly described below. Obviously, the drawings in the following description are merely some embodiments of the present application. Those of ordinary skills in the art can also obtain other drawings based on these drawings without going through any creative effort.

DESCRIPTION OF EMBODIMENTS

Unless otherwise defined, all the technical and scientific terms used herein have the same meaning as commonly understood by those skilled in the art. The terms used in the specification of the present application are only for the purpose of describing specific embodiments and are not intended to limit the present application. The terms "comprise" and "provided with" and any variations thereof in the specification and claims of the present application and the above drawings are intended to cover non-exclusive inclusion. The terms "first", "second" and the like in the description and claims as well as the above drawings of the present application are used to distinguish different objects, and are not necessarily used to describe a specific sequence.

Reference herein to "an embodiment" means that a particular feature, structure, or character described in connection with the embodiment may be included in at least one embodiment of the present invention. The appearances of the phrase in various places in the specification are not necessarily all referring to the same embodiment, nor are separate or alternative embodiments mutually exclusive with other embodiments. It is explicitly and implicitly understood by those skilled in the art that the embodiments described herein may be combined with other embodiments.

To enable a person skilled in the art to better understand the solutions of the present application, the following clearly and completely describes the technical solutions in the embodiments of the present application with reference to the accompanying drawings.

Figure 1:
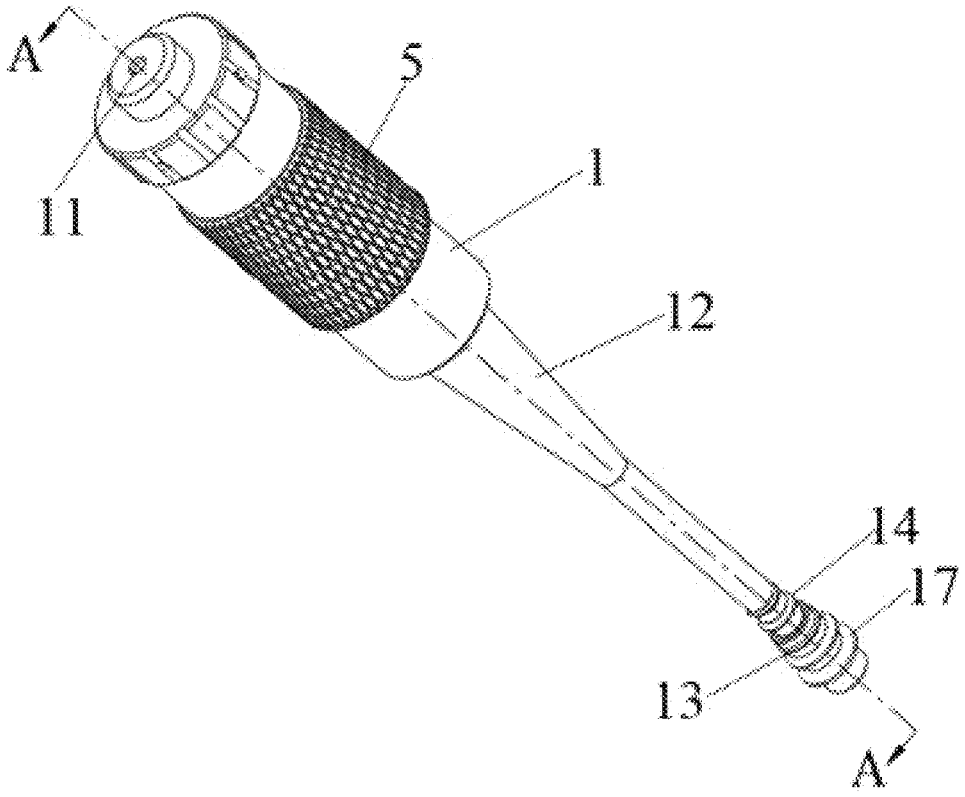
FIG. 1 is a schematic diagram of an overall structure of the present invention.
Figure 2:
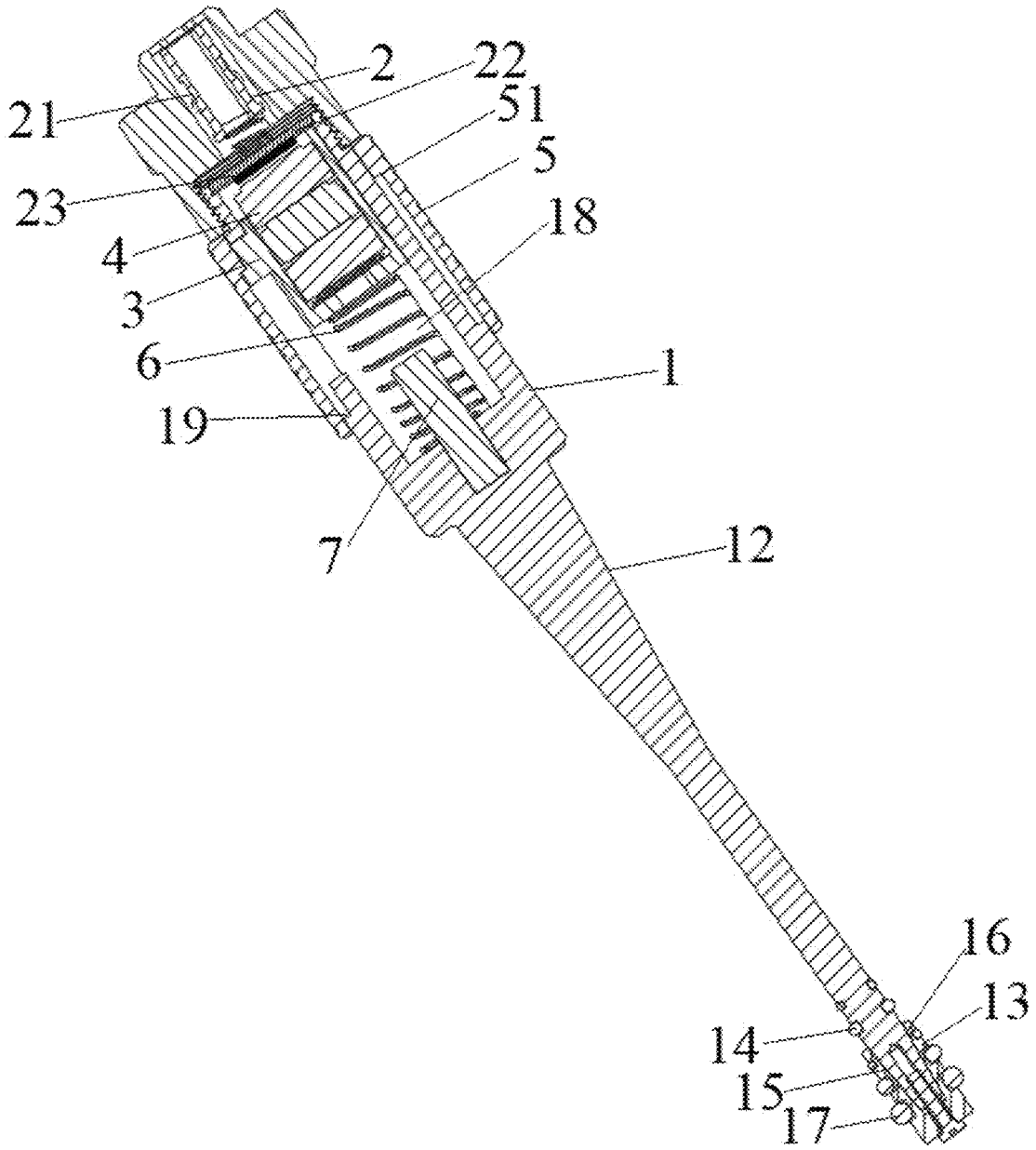
FIG. 2 is a schematic structural diagram of a cross section A-A in FIG. 1.
Figure 3:
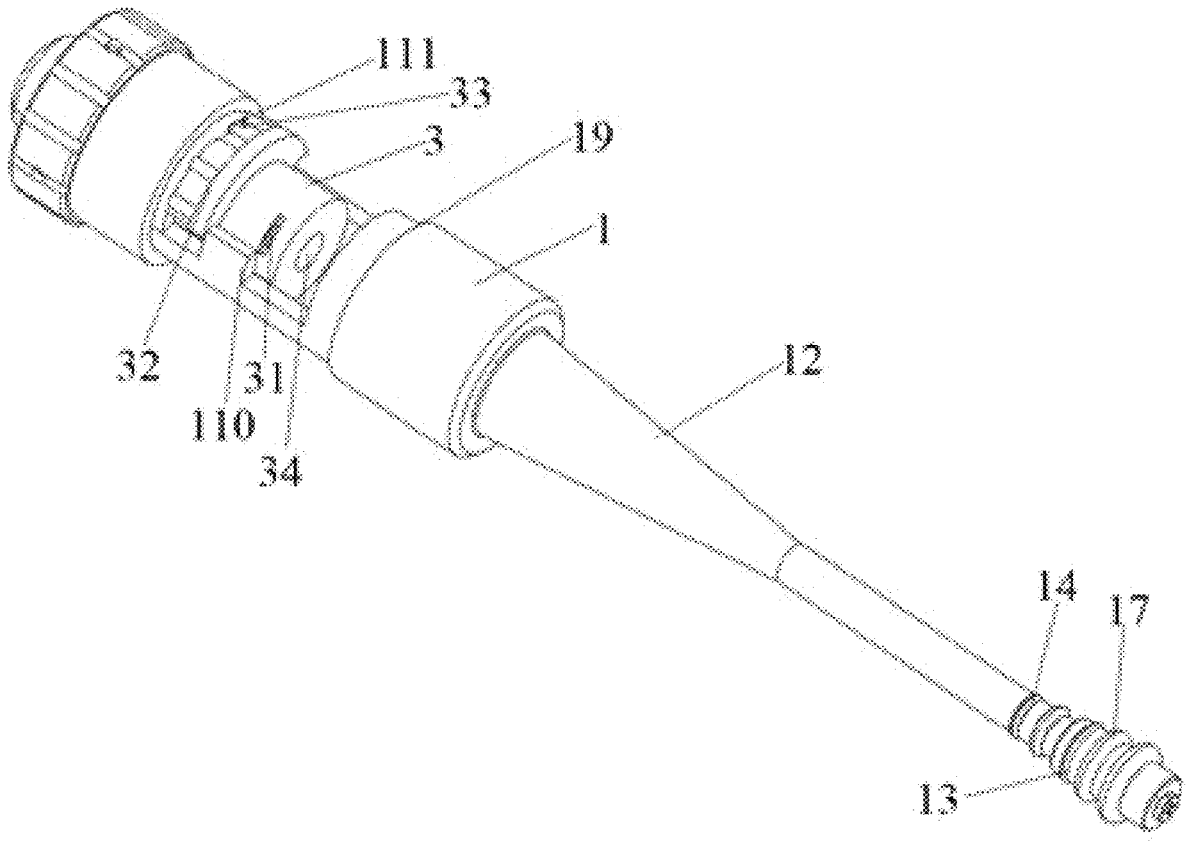
FIG. 3 is a schematic structural diagram after a battery cover is removed according to an embodiment of the present application.
Figure 4:
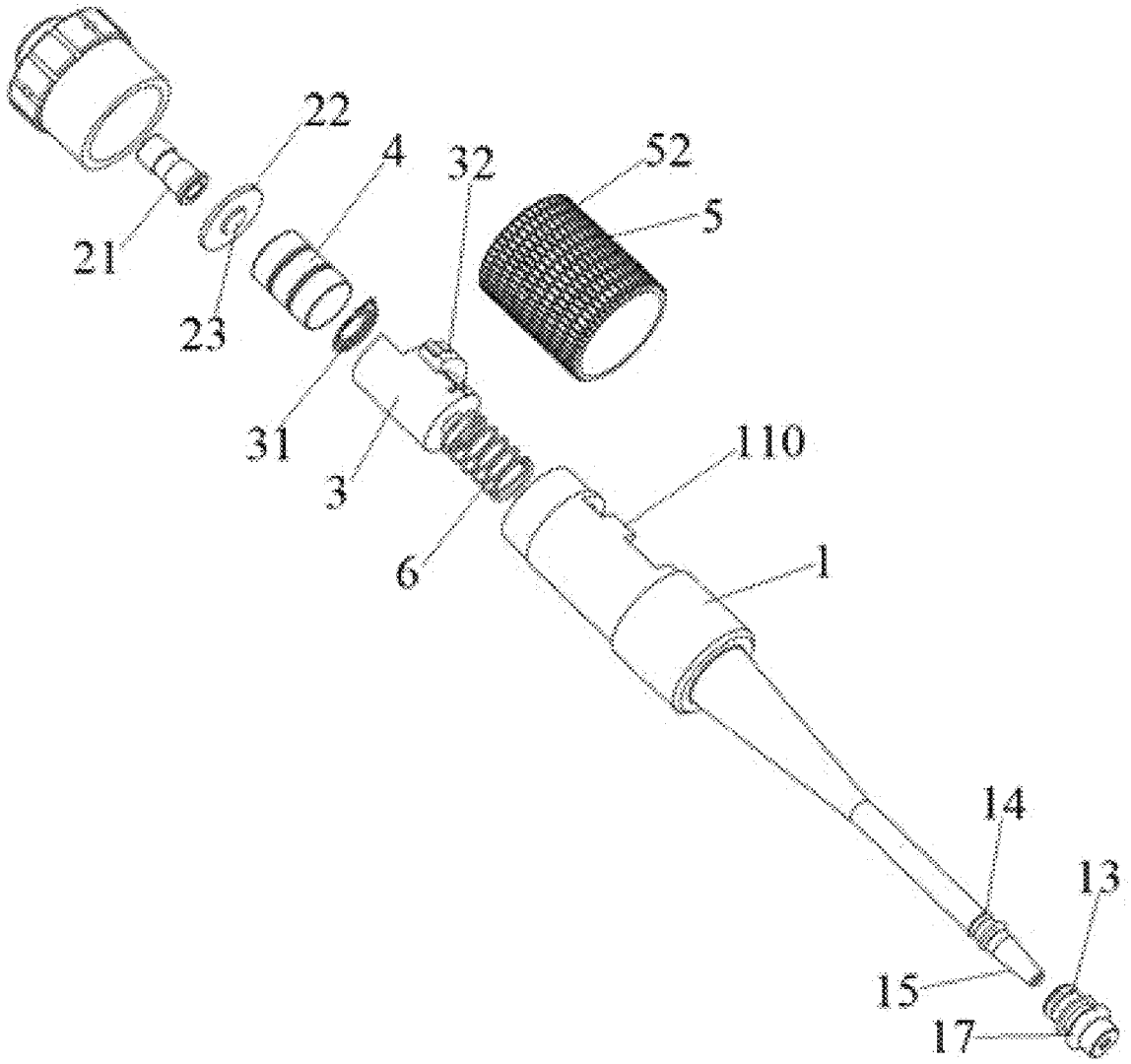
FIG. 4 is a schematic diagram of an exploded structure according to the embodiment of the present application.

As shown in FIGS. 1 to 4, an auxiliary device for calibrating an aim point of a firearm, comprising a shell 1, wherein the shell 1 is internally provided with a laser emitting assembly 2, the laser emitting assembly 2 emits visible light beams, one end surface of the shell 1 is provided with a light emitting hole 11, and light beams emitted by the laser emitting assembly 2 are emitted from the light emitting hole 11. In this embodiment, the laser emitting assembly 2 emits red light beams. In other embodiments, the laser emitting assembly 2 may also emit visible light beams in any other color.

One end of the shell 1 away from the light emitting hole 11 is provided with a limiting end, and the limiting end is used for installing and limiting the auxiliary device on a barrel of the firearm. An outer side wall of the limiting end is provided with a first frustum inclined plane 12, an end portion of the limiting end is provided with a limiting mechanism, and central axes of the light emitting hole 11, the first frustum inclined plane 12 and the limiting mechanism are coincident.

When the auxiliary device is used for calibrating the aim point of the firearm, the limiting end is inserted into the barrel of the firearm, so that the first frustum inclined plane 12 is abutted against an end portion of an inner wall of the barrel and the limiting mechanism is abutted against the inner wall of the barrel, thus fixing the auxiliary device on the barrel, and then controlling the laser emitting assembly 2 to emit visible light beams. In this case, the central axis of the first frustum inclined plane 12 is coincident with a central axis of the barrel, thus ensuring that the central axis of the light emitting hole 11 is coincident with the central axis of the barrel. Therefore, it is possible to determine that a light emitting point of the laser emitting assembly 2 is a hit point of the firearm, and then the firearm aiming calibration can be completed by adjusting the rear sight and the front sight to make the gap on the rear sight, the front sight and a point of irradiation are in one straight line.

The limiting mechanism comprises a casing pipe 13 and a first sealing piece 14. The first sealing piece 14 is sleeved on an outer wall of the limiting end; the casing pipe 13 is sleeved with one end of the limiting end away from the light emitting hole 11, the outer side wall of the limiting end is provided with a second frustum inclined plane 15, an inclined plane hole 16 adapted to the second frustum inclined plane 15 is arranged in the casing pipe 13, and the limiting end is inserted into the inclined plane hole 16, so that the second frustum inclined plane 15 is abutted against an inner wall of the inclined plane hole 16, and an end portion of the casing pipe 13 is fixedly connected with the limiting end through a screw. By arranging the second frustum inclined plane 15 and the inclined plane hole 16, it can be ensured that a central axis of the casing pipe 13 is coincident with a central axis of the limiting end.

The casing pipe 13 is provided with a second sealing piece 17, and the first sealing piece 14 and the second sealing piece 17 are respectively coincident with the central axis of the first frustum inclined plane 12. The first sealing piece 14 and the second sealing piece 17 are both silica gel rings. In other embodiments, the first sealing piece 14 and the second sealing piece 17 may also be other elastic devices.

Diameters of the first sealing piece 14 and the second sealing piece 17 are different, and the first sealing piece 14 and the second sealing piece 17 are provided for adapting to firearms with different calibers. When the auxiliary device works, the first sealing piece 17 or the second sealing piece 17 is in sealing contact with the inner wall of the barrel, thus ensuring that the auxiliary device will not shake.

In this embodiment, a number of the first sealing piece 14 is two, a number of the second sealing piece 17 is three, and the diameters of each first sealing piece 14 and each second sealing piece 17 are different, so that the auxiliary device may be applied to firearms with more calibers. In other embodiments, the number of the first sealing piece 14 and the number of the second sealing piece 17 may be any other number.

The laser emitting assembly 2 comprises a laser 21 and a circuit board 22, the laser 21 and the circuit board 22 are respectively fixedly installed in the shell 1, the laser 21 is used for emitting visible light beams, and the laser 21 is connected with the circuit board 22. An accommodating cavity 18 is arranged in the shell 1, a power supply assembly is arranged in the accommodating cavity 18, a connecting piece 23 is arranged on the circuit board 22, the power supply assembly is connected with the circuit board 22 through the connecting piece, and the power supply assembly is used for supplying power to the laser 21.

The power supply assembly comprises a battery holder 3, the battery holder 3 is used for containing a battery 4, a bottom end of an inner wall of the battery holder 3 is provided with a connecting piece 31, and the connecting piece 31 is used for connecting the battery 4 with the shell 1. An outer side of the shell 1 is sleeved with a battery cover 5, the shell 1 is provided with a gap, and the gap is communicated with the accommodating cavity 18. An inner wall of the battery cover 5 is fixedly connected with the battery holder 3 through the gap, and the battery cover 5 can drive the battery holder 3 to rotate in situ move up and down. The battery cover 5 drives the battery holder 3 to rotate, which can control the power-on or power-off of the laser 21. When the battery cover 5 drives the battery holder 3 to rotate, the connecting piece 31 rotates synchronously with the battery holder 3 to connect with the shell 1, so that the laser 21 can be powered on to work.

An outer wall of the shell 1 is provided with a first boss 19, and an inner wall of the battery cover 5 is provided with a second boss 51. The first boss 19 and the second boss 51 are provided to limit the battery cover 5 to move up and down. When the battery cover 5 drives the battery holder 3 to move, an end surface of the second boss 51 can be abutted against an end surface of the first boss 19. The gap can be opened or closed by the battery cover 5 driving the battery holder 3 to move up and down, which is convenient for replacing the battery 4 in the battery holder 3.

The battery holder 3 is provided with a clamping block 32, the battery cover 5 is sleeved on an outer side of the battery holder 3 and is fixedly connected with the clamping block 32. The shell 1 is provided with a limiting block 110. When the battery cover 5 drives the battery holder 3 to rotate to a power-on position of the laser 21, the connecting piece 31 can be connected with the shell 1, and at the same time, the clamping block 32 can also be abutted against the limiting block 110. Through the cooperation between the clamping block 32 and the limiting block 110, the battery holder 3 and the shell 1 are limited and fixed when the laser 21 is powered on, thus ensuring the power-on stability of the laser 21. When the battery 4 needs to be replaced, the battery compartment battery holder 3 is driven to rotate synchronously by rotating the battery cover 5, so that the clamping block 32 is disconnected from the limiting block 110. Then, the battery holder 3 moves downwards synchronously by pulling down the battery cover 5, and the battery cover 5 will open the gap on the shell 1 during the downward movement, which is convenient for a user to replace the battery 4.

A bump 111 is arranged on a part of the shell 1 connected with the battery holder 3, and a clamping groove 33 adapted to the bump 111 is arranged on a side edge of the battery holder 3 corresponding to the bump 111. When the battery cover 5 drives the battery holder 3 to rotate, the bump 111 can be connected with the clamping groove 33. There are two clamping grooves 33, and when one clamping groove 33 is connected with the bump 111, the laser 21 is in a power-off state. When the clamping groove 33 is connected with the bump 111, the laser 21 is in a power-on state. In this way, when the battery cover 5 is rotated, the user can judge whether the laser 21 is powered on or not by hand feeling.

In another embodiment, a second clamping groove is additionally arranged on the battery holder 3. When the battery cover 5 drives the battery holder 3 to rotate until the locking block 32 is separated from the limiting block 110, the bump 111 can be connected with the second clamping groove in this case. When the battery 4 needs to be replaced, the user rotates the battery cover 5 and can judge whether the battery cover 5 is rotated in place by hand feeling.

An outer wall of the battery cover 5 is provided with an anti-slip groove 52. The anti-slip groove 52 forms a net structure, which can effectively prevent the user from slipping when rotating or pulling the battery cover 5. In other embodiments, the outer wall of the battery cover 5 may also be provided with other types of anti-skid structures, such as anti-skid protruding points, anti-skid protruding grooves or anti-skid handles.

An elastic piece 6 is arranged in the accommodating cavity 18, one end of the elastic piece 6 is connected with a lower surface of an inner wall of the accommodating cavity 18, and the other end of the elastic piece 6 is abutted with a bottom surface of the battery holder 3. When disassembling the battery 4, the user pulls down the battery cover 5 and moves the battery holder 3 downward, and the battery holder 3 will compress the elastic piece 6 during the downward movement. When a pulling force of the user disappears, the battery holder 3 and the battery cover 5 can be driven to reset upward under the action of an elastic force of the elastic piece 6, so that the battery 4 is connected with the connecting piece 23, and efficiency of replacing the battery 4 is improved.

In this embodiment, the elastic piece 6 is a spiral spring. In other embodiments, the elastic piece 6 may also be other elastic structure, for example, an elastic sheet, and the like.

A jacking post 7 is arranged in the accommodating cavity 18, one end of the jacking post 18 is connected with the shell 1, the other end of the jacking post 7 extends into the accommodating cavity 18, a lower end surface of the battery holder 3 is provided with a through hole 34, and a diameter of the through hole 34 is matched with an outer diameter of the jacking post 7. When the battery 4 is disassembled, the battery cover 5 is pulled down to drive the battery holder 3 to move down, and the jacking post 7 can be inserted into the through hole 34 during the downward movement of the battery holder 3, thereby ejecting the battery 4 out from the battery holder 3. Efficiency of replacing the battery 4 can be improved by providing the jacking post 7.

When the battery 4 of the auxiliary device needs to be replaced, the user first rotates the battery cover 5 to drive the battery holder 3 to rotate synchronously, so that the clamping block 32 is separated from the limiting block 110. Next, the battery cover 5 is pulled down to drive the battery holder 3 to move downward, and the jacking post 7 passes through the through hole 34 of the battery holder 3 during the downward movement of the battery holder 3, thereby ejecting the battery 4 out from the battery holder 3, which facilitates the user to take out and install the battery 4. The battery holder 3 will compress the elastic piece 6 during the downward movement. After the battery 4 is installed, the user will release the pulling force on the battery cover 5, and under an elastic force of the elastic piece 6, the battery holder 3 and the battery cover 5 will be driven to move upward, so that the battery 4 is connected with the connecting piece 23. Then, the battery cover 5 is rotated to make the clamping block 32 be abutted against the limiting block 110. Subsequently, the battery cover 5 is rotated to make the clamping block 32 be abutted against the limiting block 110.

When the auxiliary device is used for calibrating the aiming of the firearm, firstly, the first sealing piece 14 or the second sealing piece 17 adapted to the caliber of the firearm is sleeved on the limiting end. Then, the limiting end is inserted into the barrel, so that the first sealing piece 14 or the second sealing piece 17 is abutted against the inner wall of the barrel, and the first frustum inclined surface 12 is abutted against an end portion of the inner wall of the barrel, thereby fixing the auxiliary device on the firearm. By rotating the battery cover 5, the battery holder 3 is driven to rotate, and the connecting piece 31 is connected with the shell 1, so that the laser 21 is powered on to work and emits red light beams. By adjusting a front sight and a rear sight, the user can adjust a gap of the rear sight, the front sight and a point of irradiation of the laser to one straight line, thus completing the aiming calibration of the firearm.

Apparently, the embodiments described above are only a part but not all of the embodiments of the present application, and the accompanying drawings illustrate preferred embodiments of the present application, but do not limit the patent scope of the present application. The present application may be implemented in many different forms, and on the contrary, the purpose of providing these embodiments is to make the understanding of the disclosed contents of the present application more thorough and comprehensive. Although the present application is described in detail with reference to the foregoing embodiments, for a person skilled in the art, the technical solutions described in the foregoing embodiments may still be modified, or some of the technical features may be equivalently replaced. Any equivalent structure made by using the specification and the drawings of the present application which is directly or indirectly used in other related technical fields, similarly falls within the patent protection scope of the present application.

What is claimed is:

1. An auxiliary device for calibrating an aim point of a firearm, comprising: a shell, wherein the shell is internally provided with a laser emitting assembly, the laser emitting assembly emits visible light beams, one end surface of the shell is provided with a light emitting hole, one end of the shell away from the light emitting hole is provided with a limiting end, and the limiting end is used for installing and limiting the auxiliary device on a barrel of the firearm;

an outer side wall of the limiting end is provided with a first circular truncated cone inclined surface, an end portion of the limiting end is provided with a limiting mechanism, and central axes of the light emitting hole, the first frustum inclined plane and the limiting mechanism are coincident;

the laser emitting assembly comprises a laser and a circuit board, and the laser is connected with the circuit board;

an accommodating cavity is arranged in the shell, a power supply assembly is arranged in the accommodating cavity, the power supply assembly is used for supplying power to the laser, and the power supply assembly is connected with the circuit board;

the power supply assembly comprises a battery holder, a connecting piece is arranged on the battery holder, the battery holder is used for containing a battery, and the connecting piece is used for connecting the battery with the shell;

an outer side of the shell is sleeved with a battery cover, the battery cover is connected with the battery holder, and the battery cover drives the battery holder to rotate and move;

when the battery cover drives the battery holder to rotate, the connecting piece is connected with the shell;

an elastic piece is arranged in the accommodating cavity, one end of the elastic piece is connected with a lower surface of an inner wall of the accommodating cavity, and the other end of the elastic piece is abutted with the battery holder;

a jacking post is arranged in the accommodating cavity, one end of the jacking post is connected with the shell, the other end of the jacking post extends into the accommodating cavity, a lower end surface of the battery holder is provided with a through hole, and a diameter of the through hole is matched with an outer diameter of the jacking post; and when the battery cover drives the battery holder to move, the top post is inserted into the through hole;

wherein an outer wall of the shell is provided with a first boss, and an inner wall of the battery cover is provided with a second boss; and when the battery cover drives the battery holder to move, an end surface of the second boss is abutted against an end surface of the first boss.

2. The auxiliary device for calibrating the aim point of the firearm according to claim 1, wherein the limiting mechanism comprises a casing pipe and a first sealing piece, the first sealing piece is sleeved on an outer wall of the limiting end, the casing pipe is connected with one end of the limiting end away from the light emitting hole, the casing pipe is provided with a second sealing piece, and the first sealing piece and the second sealing piece are respectively coincident with the central axis of the first frustum inclined plane.

3. The auxiliary device for calibrating the aim point of the firearm according to claim 2, wherein the outer side wall of the limiting end is provided with a second frustum inclined plane, and an inclined plane hole adapted to the second frustum inclined plane is arranged in the casing pipe.

4. The auxiliary device for calibrating the aim point of the firearm according to claim 1, wherein the battery holder is provided with a clamping block, and the shell is provided with a limiting block; and when the battery cover drives the battery holder to move, the clamping block is abutted against the limiting block.

5. The auxiliary device for calibrating the aim point of the firearm according to claim 1, wherein a bump is arranged on a part of the shell connected with the battery holder, and a clamping groove adapted to the bump is arranged on the battery holder; and when the battery cover drives the battery holder to move, the bump is connected with the clamping groove.

* * * * *